US007871159B2

(12) United States Patent
Gold et al.

(10) Patent No.: US 7,871,159 B2
(45) Date of Patent: Jan. 18, 2011

(54) INK LOADER WITH ADJUSTABLE INSERTION OPENINGS

(75) Inventors: Christopher Ryan Gold, Tigard, OR (US); Barry D. Reeves, Lake Oswego, OR (US); Gustavo J. Yusem, Tigard, OR (US); William Loren Emery, Sherwood, OR (US)

(73) Assignee: Xerox Corporation, Norwalk, CT (US)

( * ) Notice: Subject to any disclaimer, the term of this patent is extended or adjusted under 35 U.S.C. 154(b) by 380 days.

(21) Appl. No.: 12/181,347

(22) Filed: Jul. 29, 2008

(65) Prior Publication Data

US 2010/0026768 A1 Feb. 4, 2010

(51) Int. Cl.
*B41J 2/175* (2006.01)

(52) U.S. Cl. ..... 347/88

(58) Field of Classification Search ..... 347/88, 347/86

See application file for complete search history.

(56) References Cited

U.S. PATENT DOCUMENTS 6,705,710 B2 3/2004 Reeves et al.
6,709,094 B2 3/2004 Jones
6,719,413 B2 4/2004 Jones
7,108,363 B2 9/2006 Jones et al.
2004/0021751 A1 * 2/2004 Steinmetz et al. ..... 347/86

* cited by examiner

*Primary Examiner*—Julian D Huffman
*Assistant Examiner*—Jason S Uhlenhake
(74) *Attorney, Agent, or Firm*—Maginot, Moore & Beck LLP

(57) ABSTRACT

A system for use with a solid ink delivery system of a phase change ink imaging device comprises an insertion opening configured to enable insertion of ink sticks therethrough and into the ink delivery system. An insertion key is movably supported adjacent the insertion opening such that a portion of the insertion key protrudes into the insertion opening. The portion of the insertion key has a shape that is complementary to a key contour on a first ink stick and a second ink stick. A key positioner is operably coupled to the insertion key to move the insertion key between at least two different predetermined positions on the perimeter of the insertion opening. The predetermined positions include a first position that is complementary to a position of the key contour of the first ink stick and a second position that is complementary to a position of the key contour of the second ink stick.

20 Claims, 10 Drawing Sheets

INK LOADER WITH ADJUSTABLE INSERTION OPENINGS

TECHNICAL FIELD

This disclosure relates generally to phase change inkjet printers that use phase change ink sticks, and, in particular, to the insertion openings for inserting the ink sticks into the printers.

BACKGROUND

Solid ink or phase change ink printers conventionally receive ink in a solid form, either as pellets or as ink sticks. The solid ink pellets or ink sticks are typically inserted through an insertion opening of an ink loader for the printer, and the ink sticks are pushed or slid along the feed channel by a feed mechanism and/or gravity toward a heater plate in the heater assembly. The heater plate melts the solid ink impinging on the plate into a liquid that is delivered to a print head for jetting onto a recording medium.

One difficulty faced in solid ink technology is identification and authentication of ink sticks to ensure the correct loading and compatibility of an ink stick with the imaging device in which it is used. For example, unlike powdered or liquid marking materials, the solid form of ink sticks allows the ink sticks to be handled and loaded into a phase change ink printer without the need for a container or cartridge, as is typically required for liquid ink or powdered toner. In addition, the entire ink stick may be melted and consumed, with no need to dispose of, or recycle, any container. Eliminating the need for a container provides many advantages to the use of ink sticks. Containers or cartridges, however, may be provided with electronic tags, barcodes, etc. that may be used to identify and/or authenticate the ink contained therein. Without the use of a container, the mechanisms for authenticating or otherwise identifying the ink stick may be limited.

Provisions have been made to ensure that an ink stick is correctly loaded into the intended feed channel and to ensure that the ink stick is compatible with that printer. One provision is generally directed toward excluding wrong colored or incompatible ink sticks from being inserted into the feed channels of the printer. For example, the correct loading of ink sticks has been accomplished by incorporating keying features into the exterior surface of an ink stick. These features are protuberances or indentations that are located in different positions on an ink stick. An ink stick that does not have the appropriate key elements in the correct position for the particular insertion opening is excluded from insertion.

Ink sticks may be differentiated by keying features according to color as well as intended printing platform or series of printer. World markets, however, have created a situation where ink sticks may have to be differentiated, for example, by pricing, color table preferences, marketing programs, and geographic distribution in addition to color and/or intended printer model. Numerous different keying feature configurations must be incorporated into ink sticks in order to differentiate ink sticks based on color, printer model, marketing program, price point, geographic area, etc. A separate key plate or insertion opening configuration has been typically required for each different keying feature configuration incorporated into ink sticks.

SUMMARY

As an alternative to providing a separate key plate or insertion opening configuration for each different ink stick key configuration, an adjustable insertion opening system has been developed that enables shape keyed insertion openings to be adjusted to accept at least two different ink stick configurations. In particular, a system for use with a solid ink delivery system of a phase change ink imaging device comprises an insertion opening configured to enable insertion of ink sticks therethrough and into the ink delivery system. An insertion key is movably supported adjacent the insertion opening such that a portion of the insertion key protrudes into the insertion opening. The portion of the insertion key has a shape that is complementary to a key contour on a first ink stick and a second ink stick. A key positioner is operably coupled to the insertion key to move the insertion key between at least two different predetermined positions on the perimeter of the insertion opening. The predetermined positions include a first position that is complementary to a position and shape of the key contour of the first ink stick and a second position that is complementary to a position and shape of the key contour of the second ink stick.

In another embodiment, a system for use with a phase change ink imaging device comprises an ink delivery system for a phase change ink imaging device; and a plurality of adjustable insertion openings configured to enable insertion of ink sticks therethrough and into the ink delivery system. Each opening in the plurality of insertion openings is configured to receive a different color of ink stick, each of the adjustable insertion openings in the plurality include an insertion key movably supported adjacent the respective insertion opening such that a portion of the insertion key protrudes into the insertion opening. The portion of the insertion key has a shape that is complementary to a ink stick key contour that is incorporated into a first and a second set of multi-color ink sticks. A key positioner is operably coupled to each of the insertion keys in the plurality that is configured to move the insertion keys such that the portion of the insertion key that protrudes into the respective insertion openings is moved between at least two different predetermined positions on the perimeter of the insertion opening. The at least two predetermined positions include a first position that is complementary to a position and shape of the key contour on the first set of ink sticks and a second position that is complementary to a position and shape of the key contour on the second set of ink sticks.

In yet another embodiment, a phase change ink imaging device is provided. The phase change ink imaging device comprises a phase change ink printhead configured to eject melted phase change ink onto an ink receiver. An ink delivery system configured to receive solid ink sticks and to transport the solid ink sticks to an ink melter for melting and delivery to the phase change ink printhead. A plurality of adjustable insertion openings is configured to enable insertion of ink sticks therethrough and into the ink delivery system. Each opening in the plurality of insertion openings is configured to receive a different color of ink stick and includes an insertion key movably supported adjacent the respective insertion opening such that a portion of the insertion key protrudes into the insertion opening. The portion of the insertion key has a shape that is complementary to a ink stick key contour that is incorporated into a first and a second set of multi-color ink sticks. A key positioner is operably coupled to each of the insertion keys in the plurality that is configured to move the insertion keys such that the portion of the insertion key that protrudes into the respective insertion openings is moved between at least two different predetermined positions on the perimeter of the insertion opening. The at least two predetermined positions include a first position that is complementary to a position and shape of the key contour on the first set of ink sticks and a second position that is complementary to a position and shape of the key contour on the second set of ink sticks.

BRIEF DESCRIPTION OF THE DRAWINGS

The foregoing aspects and other features of this disclosure are explained in the following description, taken in connection with the accompanying drawings, wherein.

DETAILED DESCRIPTION

Figure 1:
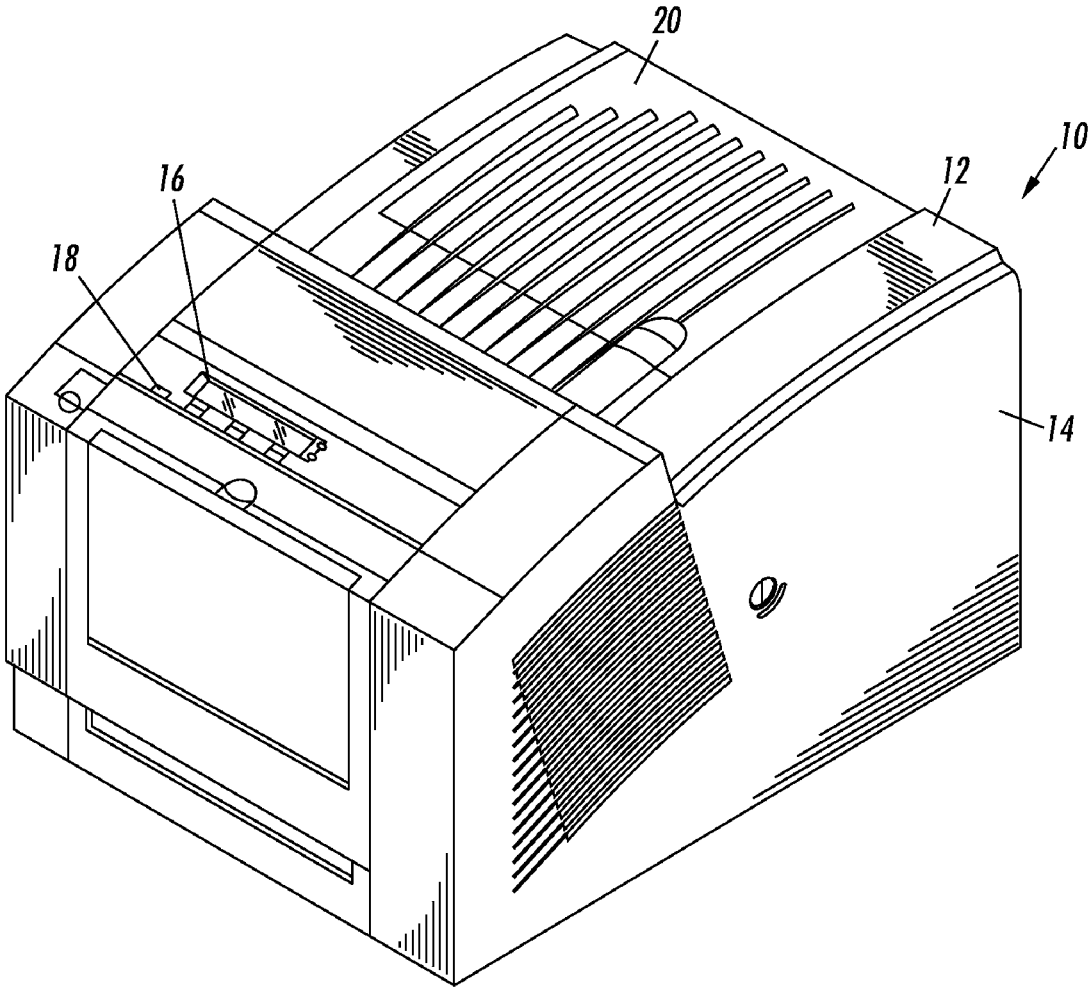
FIG. 1 is a perspective view of a phase change printer with the printer ink access cover closed.

For a general understanding of the present embodiments, reference is made to the drawings. In the drawings, like reference numerals have been used throughout to designate like elements.

As used herein, the term "imaging device" generally refers to a device for applying an image to print media. "Print media" or "recording media" can be a physical sheet of paper, plastic, or other suitable physical print media substrate for images, whether precut or web fed. The imaging device may include a variety of other components, such as finishers, paper feeders, and the like, and may have various embodiments, such as a copier, printer, or a multifunction machine. A "print job" or "document" is normally one or a set of related sheets printed or copied on the imaging device. An image generally includes information in electronic form which is to be rendered on the print media by the marking engine and may include text, graphics, pictures, and the like.

Figure 2:
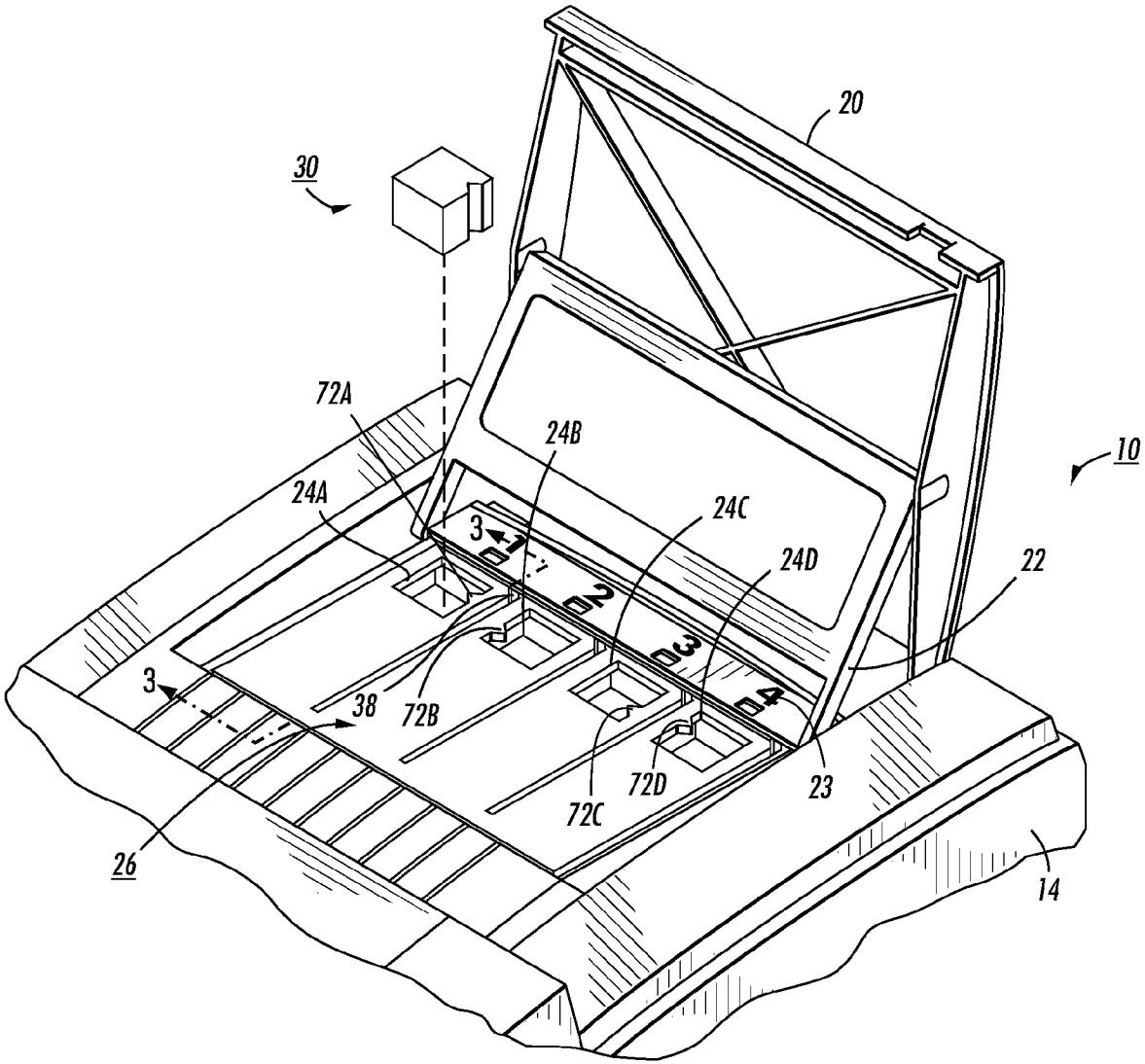
FIG. 2 is an enlarged partial top perspective view of the phase change printer with the ink access cover open, showing a solid ink stick in position to be loaded into a feed channel.

FIG. 1 shows a solid ink phase change ink imaging device 10 that includes an outer housing having a top surface 12 and side surfaces 14. A user interface, such as a front panel display screen 16, displays information concerning the status of the printer, and user instructions. Buttons 18 or other control elements for controlling operation of the printer are adjacent the user interface display screen, or may be at other locations on the printer. An ink jet printing mechanism (not shown) is contained inside the housing. An ink delivery system delivers ink to the printing mechanism. The ink delivery system is contained under the top surface of the printer housing. The top surface of the housing includes a hinged ink access cover 20 that opens, as shown in FIG. 2, to provide the user access to the ink delivery system.

Figure 3:
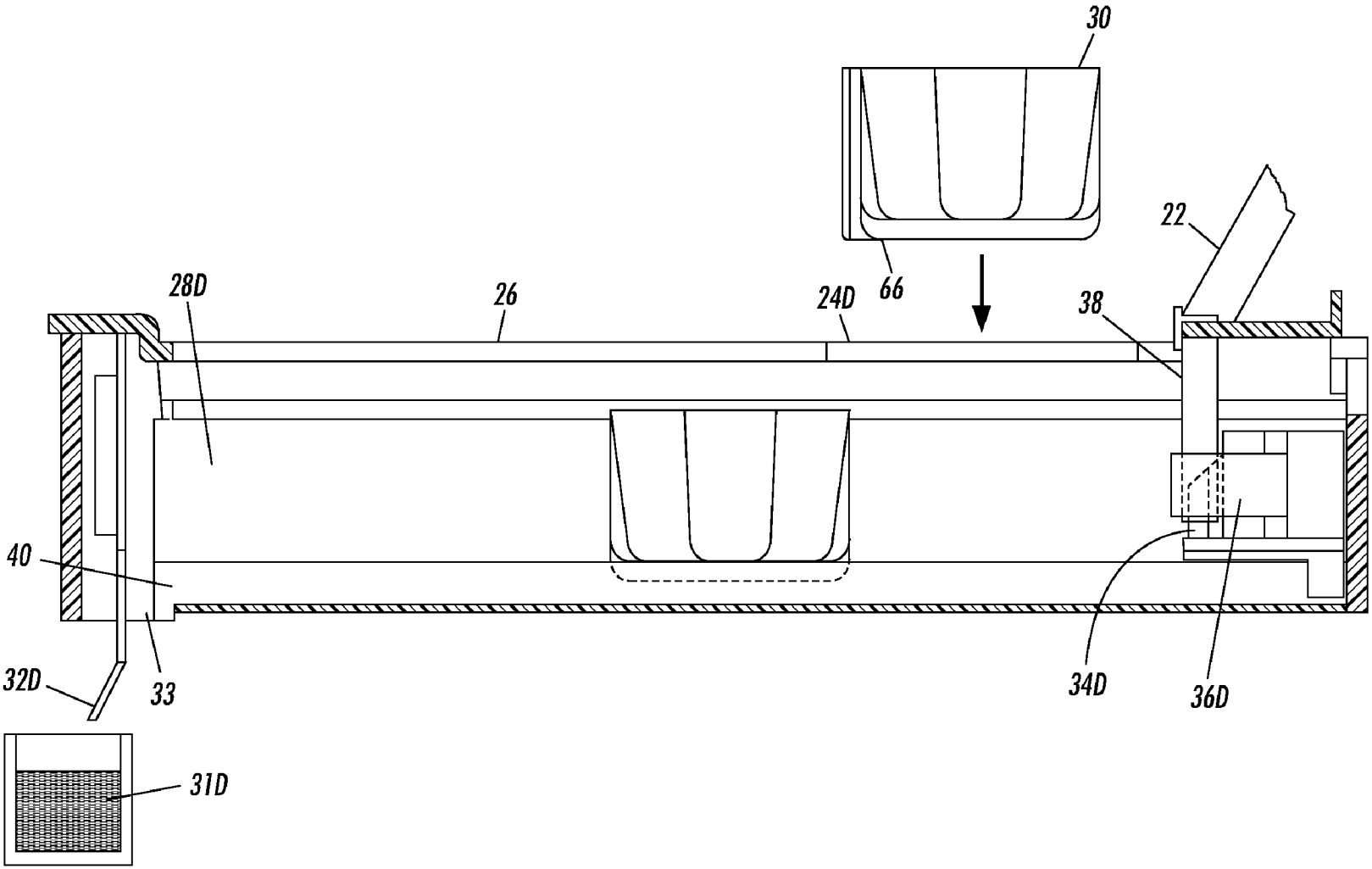
FIG. 3 is a side sectional view of a feed channel of a solid ink feed system, taken along line 3-3 of FIG. 2.

In the exemplary printer shown, the ink access cover 20 is attached to an ink load linkage element 22 so that when the printer ink access cover 20 is raised, the ink load linkage 22 slides and pivots to an ink load position. As seen in FIG. 2, opening the ink access cover reveals a key plate having keyed openings 24A, 24B, 24C, 24D. Each keyed opening 24A, 24B, 24C, 24D provides access to an insertion end of one of several individual feed channels 26 of the solid ink delivery system (FIG. 3). Each feed channel 26 delivers ink sticks 30 of one particular color to a corresponding melter, such as a melt element or melt plate 32.

Each longitudinal feed channel 28 delivers ink sticks 30 of one particular color to a corresponding melt plate 32. Each feed channel has a longitudinal feed direction from the insertion end of the feed channel to the melt end of the feed channel. The melt end of the feed channel is adjacent the melt plate. The melt plate melts the solid ink stick into a liquid form. The melted ink drips through a gap 33 between the melt end of the feed channel and the melt plate, and into a liquid ink reservoir (not shown). The feed channels 28 have a longitudinal dimension from the insertion end to the melt end, and a lateral dimension, substantially perpendicular to the longitudinal dimension. Each feed channel in the particular embodiment illustrated includes a push block 34 driven by a driving force or element, such as a constant force spring 36, to push the individual ink sticks along the length of the longitudinal feed channel toward the melt plates 32 that are at the melt end of each feed channel. The tension of the constant force spring 36 drives the push block toward the melt end of the feed channel. In a manner similar to that described in U.S. Pat. No. 5,861,903, the ink load linkage 22 is coupled to a yoke 38, which is attached to the constant force spring 36 mounted in the push block 34. The attachment to the ink load linkage 22 pulls the push block 34 toward the insertion end of the feed channel when the ink access cover is raised to reveal the key plate 26. The constant force spring 36 can be a flat spring with its face oriented along a substantially vertical axis. Persons familiar with the art will identify that other orientations of the ink stick feed channel may be used, and that other techniques are available to move the ink sticks from the insertion end of the feed channel to the melt end.

A color printer may use four colors of ink (yellow, cyan, magenta, and black). Ink sticks 30 of each color are delivered through a corresponding individual one of the solid ink feed channels 28A, 28B, 28C, 28D. The key plate 26 has keyed openings 24A, 24B, 24C, 24D to aid the printer user in ensuring that only ink sticks of the proper color are inserted into each feed channel. Each keyed opening of the key plate has a unique shape. The ink sticks 30 of the color for that feed channel have a shape corresponding to the shape of the keyed opening. The keyed openings and corresponding ink stick shapes exclude from each ink feed channel ink sticks of all colors except the ink sticks of the proper color for that feed channel of that particular printer.

Figure 4:
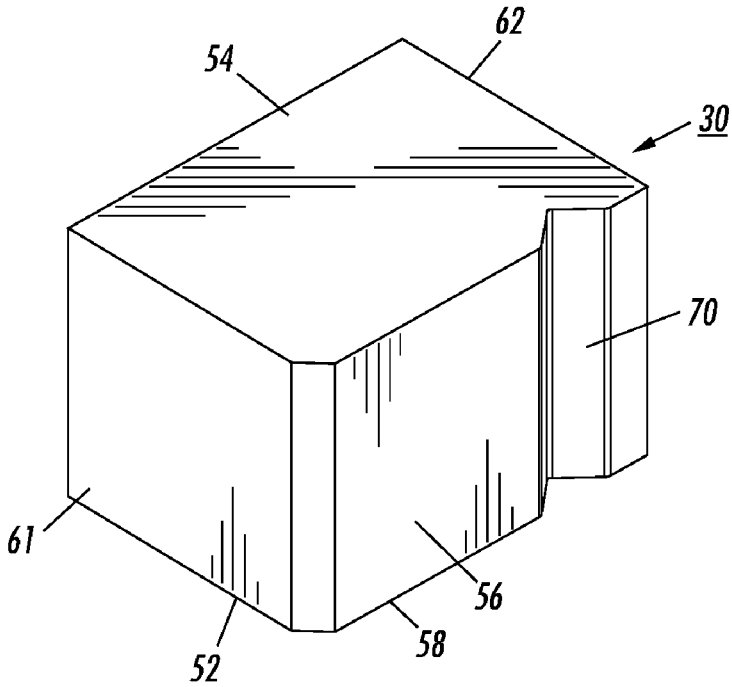
FIG. 4 is a perspective view of an embodiment of a solid ink stick.

An ink stick may take many forms. One exemplary solid ink stick 100 for use in the ink delivery system is illustrated in FIG. 4. The ink stick 30 has a bottom surface 52 and a top surface 54 that are substantially parallel to one another. The ink stick body also has a plurality of side surfaces 56, 61, 62. The illustrated embodiment includes four side surfaces, including two end surfaces 61, 62 and two lateral side surfaces 56. The lateral side surfaces 56 are substantially parallel one another, and are substantially perpendicular to the top and bottom surfaces 52, 54. The end surfaces 61, 62 are also substantially parallel one another, and substantially perpendicular to the top and bottom surfaces, and to the lateral side surfaces. The surfaces of the ink stick body need not be flat, nor need they be parallel or perpendicular to one another. The ink stick is configured to fit into the feed channel with the two lateral side surfaces 56 of the ink stick body oriented along the longitudinal feed direction of the feed channel. With the substantially cubic ink stick shape illustrated, the end surfaces are thus oriented along the transverse or lateral dimension of the feed channel. One of the end surfaces 61 is a front or leading end surface, and the other end surface 62 is a rear or trailing end surface. The bottom surface has lateral edges 58 at which the bottom surface 52 intersects the lateral side surfaces 56. The ink stick body may be formed by pour molding, injection molding, compression molding, or other known techniques.

Ink sticks may include key contours that aid in the insertion of ink sticks through the correct insertion opening and corresponding feed channel associated with a particular ink stick. Key contours may comprise surface features formed into the ink stick such as protrusions and/or indentations that are located in different positions on an ink stick for interacting with complementarily shaped and positioned key elements in the insertion openings of the printer. As an example, the ink stick of FIG. 4 includes an insertion key contour 70. The insertion key contour is configured to interact with the keyed insertion openings 24 of the ink delivery system (FIG. 2) to admit or block insertion of the ink sticks through the insertion opening 24. In the ink stick embodiment of FIG. 4, the key contour 70 is a vertical recess or notch formed in side surface 56 of the ink stick body substantially parallel to the insertion direction of the ink delivery system. A complementarily shaped key element (72, FIG. 2) is included on the perimeter of the keyed openings 24. Key contours and corresponding key elements, however, may have any suitable shape including rounded, angled, stepped, etc. In the referenced illustrations, the key plate contour and complementary key contour of the ink stick are nearly identical for ease of visualization but the shapes need not match to accomplish the keying function.

Figure 5:
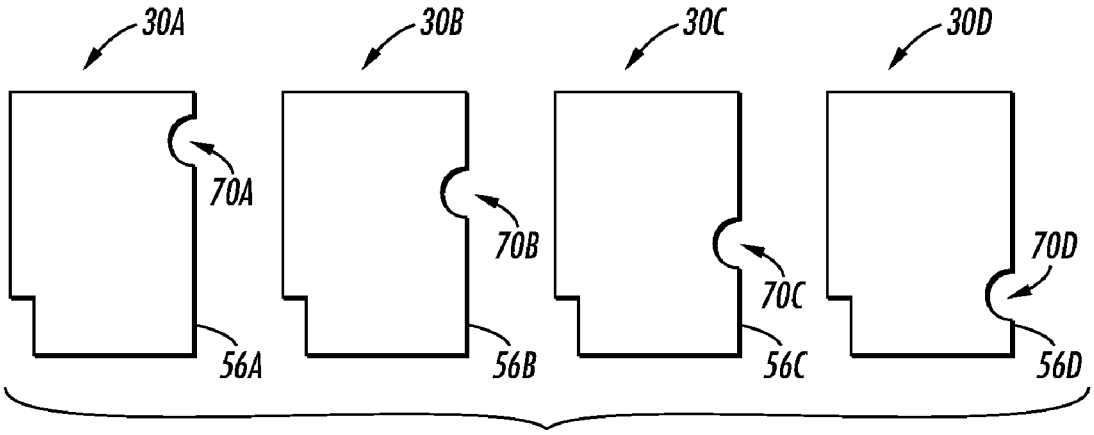
FIG. 5 is a top view of a multi-color set of ink sticks with color key contours.

Each color for a printer may have a unique arrangement of one or more key elements in the outer perimeter of the ink stick to form a unique cross-sectional shape for that particular color ink stick. The combination of the keyed openings in the key plate and the keyed shapes of the ink sticks insure that only ink sticks of the proper color are inserted into each feed channel. A set of ink sticks is formed of an ink stick of each color, with a unique key feature arrangement for ink sticks of each color. FIG. 5 shows an example of how insertion key contours 70 may be used to differentiate ink sticks of different colors. There is a set of multi-color ink sticks 30A-30D depicted in FIG. 5 with each ink stick in the stick being of a different color, e.g. cyan, magenta, yellow, and black. As can be seen, each ink stick in the set includes a color key contour, or element 70A, 70B, 70C, 70D. The key contours 70A, 70B, 70C, 70D are of substantially the same size and shape as one another, but are in different positions along the insertion perimeter of the ink stick body. In this embodiment, the color key contour 70 is positioned along the same lateral side surface 56 on each ink stick in the set although the color key contours may be positioned along substantially any surface of each ink stick. In this embodiment, the ink sticks of the set are differentiated from each other based on color by positioning the color key contour in a different position along the lateral side surface 56 for each color of ink.

Key contours may also be used to differentiate ink sticks based on other parameters besides color such as printer model, marketing program, price point, geographic area, etc. For example, all of the ink sticks that are intended to be used with a particular printer model may be equipped with a series key contour in a predetermined position on each ink stick. A series key contour that is associated with a particular model of printer may be formed on each ink stick or ink stick configuration that is compatible with or intended to be used with the particular printer model. Each insertion opening of the particular printer model may then be equipped with a key element that is complementarily shaped and positioned with respect to the series key contour incorporated into the ink sticks intended for that printer model. Ink stick groups intended for different printer models, marketing programs, price points, geographic areas, etc. may be equipped with one or more series key contours of different sizes, shapes, and/or positions on the ink sticks from group to group.

Figure 6:
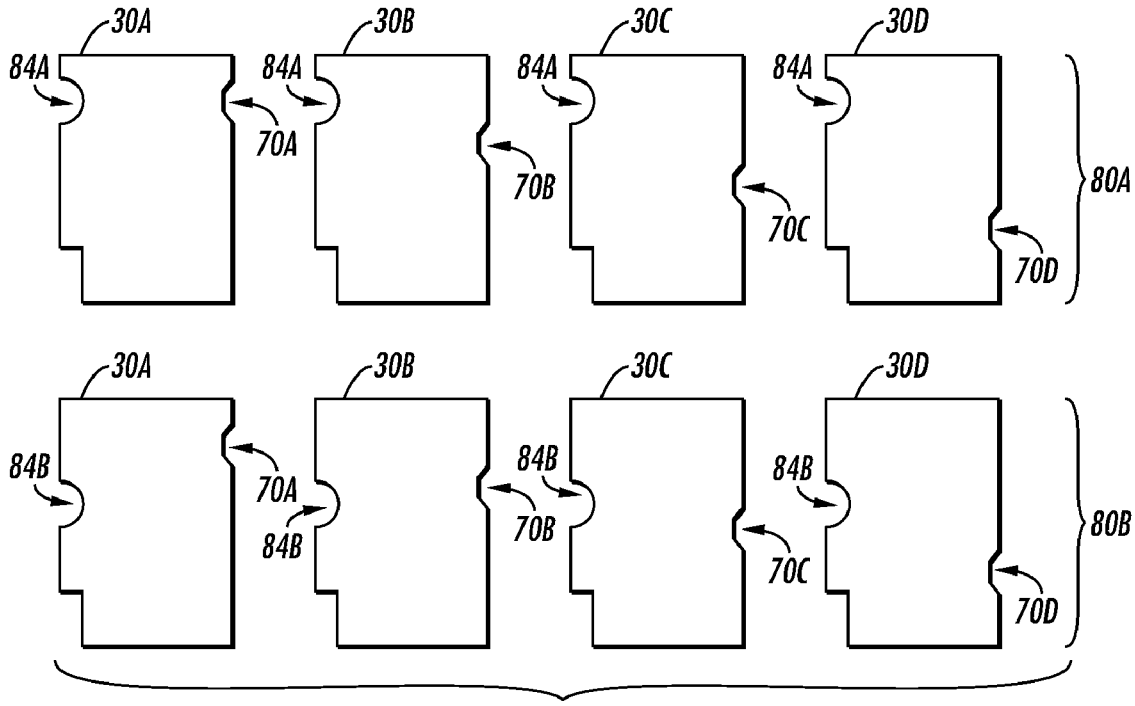
FIG. 6 is a top view of two multi-color sets of ink sticks showing color key contours and series key contours.

FIG. 6 shows an example of how series key contours may be used to differentiate ink sticks intended for different printer models, marketing programs, price points, geographic areas, etc. FIG. 6 shows two sets 80A, 80B of multi-colored ink sticks. In this example, each set of ink sticks includes a cyan (C), magenta (M), yellow (Y), and black (B) ink stick. For the sake of this description, each set of ink sticks may be compatible with the same printer model but be intended for different marketing programs, price points, geographic areas, etc. Accordingly, in this embodiment, each ink stick 30 includes a color key contour 70 that is in substantially the same position from set to set for ink sticks that are the same color. For example, the cyan ink stick 30A of set 80A has a key contour 70A in the same position on the ink stick 30A as the cyan ink stick 30A of set 80B; the magenta ink stick 30B of set 80A has a key contour 70B in the same position on the ink stick 30B as the magenta ink stick 30B of set 80B; etc. In order to differentiate the ink sticks by series, the ink sticks of the first set 80A each includes a series key contour 84A that is formed at the same position for each ink stick in the set 80A while the ink sticks of the second set 80B each includes a series key contour 84B at the same position for each ink stick in the set 80B. As can be seen, the series key contour 84A of the first set of ink sticks 80A is in a different position on the ink stick than the series key contour 84B of the second set 80B of ink sticks. As mentioned, the series key contour may be used to differentiate the ink stick sets based on marketing programs, price points, geographic areas, etc. The series key is shown in different positions to differentiate between the series but the key may also be of different size, short in the first series and long in the second series, as example.

Figure 7:
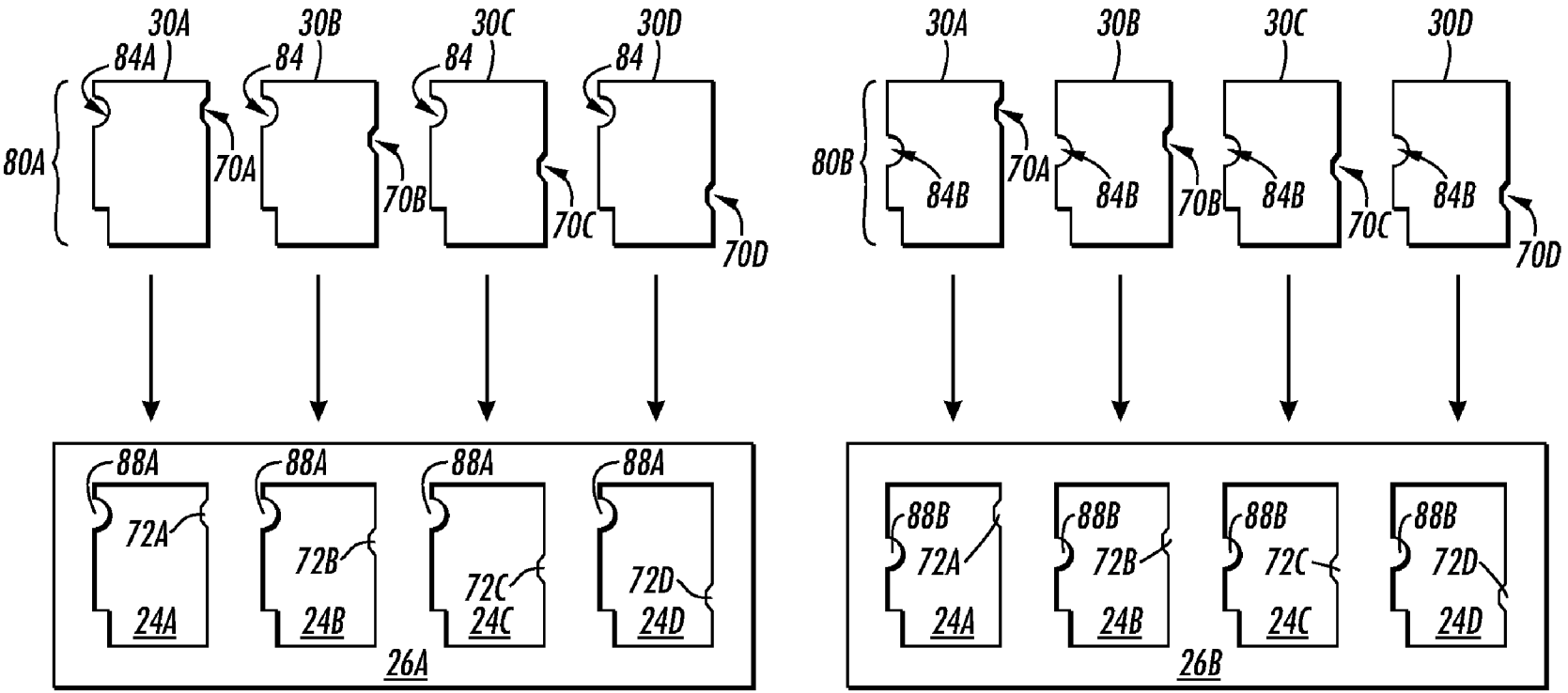
FIG. 7 shows the two sets of ink sticks of FIG. 6 and the corresponding key plates for use with the ink stick sets.

Referring to FIG. 7, key plates 26A, 26B for use with the ink stick sets 80A, 80B of FIG. 6 have keyed insertion openings that include key elements that are complementarily shaped and positioned to the key contours of the ink sticks that are intended to be inserted therethrough. As can be seen in FIG. 7, the insertion openings 24 of the key plate include color key elements 72 that are configured to interact with the color key contours 70. The insertion openings also include series key elements 88 that are configured to interact with the series key contours 84 of the ink stick sets. The key plate 26A configured for use with the first ink stick set 80A includes a series key element 88A that is configured to enable insertion of the first set of ink sticks 80A through the insertion openings 24 of the first key plate 26A while blocking or excluding from insertion the ink sticks of the second set 80B. Similarly, the insertion openings 24 of the key plate 26B include series key elements 88B that are configured to interact with the series key contours 84B of the second set of ink sticks 80B to enable insertion of the second set of ink sticks 80B through the insertion openings 24 of the second key plate 26B while blocking or excluding from insertion the ink sticks of the first set 80A.

In order to configure a printer or ink delivery system to utilize a particular ink stick configuration, ink delivery systems are equipped with the appropriate key plate 26 or insertion opening configuration corresponding to the select ink stick configuration. In previously known systems, a uniquely configured ink delivery system or at least a uniquely configured key plate 26 or insertion opening configuration has been required for each different key contour configuration incorporated into ink sticks. Due to the numerous key contour configurations that are possible, however, creating ink delivery systems or key plate configurations for each ink key configuration can be costly.

As an alternative to providing a separate key plate or insertion opening for each different key contour configuration incorporated into ink sticks, ink delivery systems may be provided with adjustable insertion openings, which may be automatic, that enable the shape of one or more insertion openings to be adjusted to accommodate different ink sticks or ink stick sets. In one embodiment, adjustable insertion openings may be implemented by using movable or mechanized insertion key elements movably positioned adjacent one or more of the insertion openings of an ink delivery system that each may be moved with respect to an insertion opening to at least two different positions along the perimeter of the insertion openings corresponding to positions of key contours that are included in at least two different ink sticks or ink stick sets.

Figure 8:
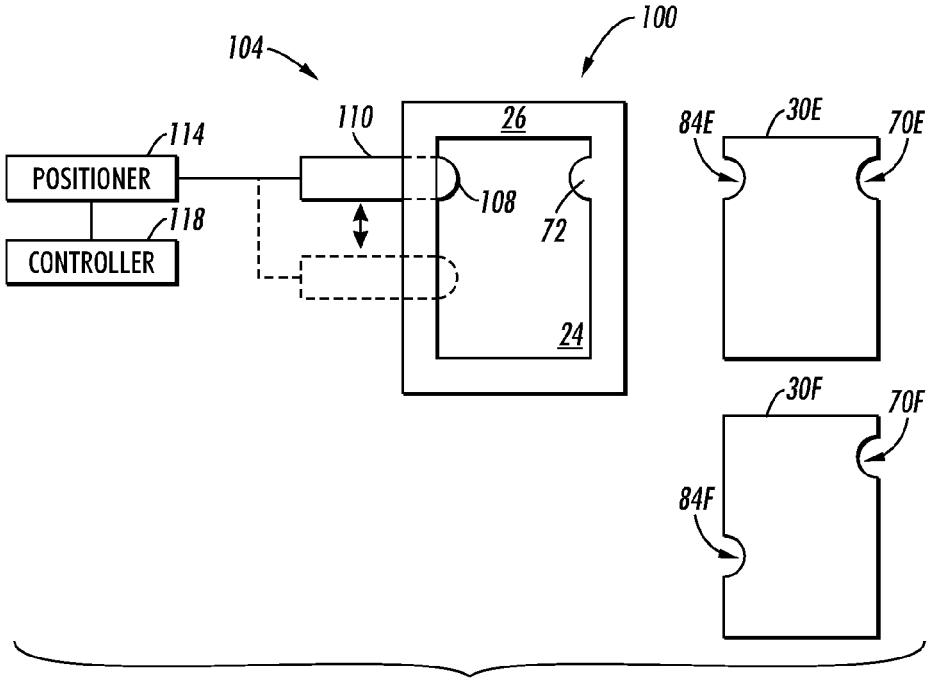
FIG. 8 shows an embodiment of an adjustable insertion opening system for use with a single insertion opening.

FIG. 8 shows a simplified embodiment of an adjustable insertion opening system 100 that may be utilized in an imaging device such as the imaging device 10 described above. In particular, the adjustable insertion opening system 100 is configured to adjust the shape of the insertion opening 24 from a first opening configuration that is complementary to the shape of a first ink stick and non-complementary to the shape of a second ink stick to at least a second opening configuration that is complementary to the shape of the second ink stick and non-complementary to the shape of the first ink stick. The shape descriptive term "complementary", as used herein, is a shape contributing to a general ink form insertion accommodation or exclusion and does not infer being the same shape or having significant shape similarity. The adjustable insertion opening system 100 of FIG. 8 includes at least one insertion opening 24 that has a perimeter shape that at least partially corresponds to the perimeter shape of a plurality of similarly configured ink sticks. The insertion opening may include fixed key elements 72 that have shapes complementary to key contours 70 positioned on ink sticks. In the embodiment of FIG. 8, the fixed key element 72 may be complementary to the color key contour 70 of ink sticks 30E and 30F. As mentioned above, ink sticks may include one or more color key contours that are in substantially the same position on ink sticks that are the same color but from different ink stick sets. The ink stick sets may be differentiated by incorporating series key contours 84 in the ink stick sets that are in the same position on an ink stick for each ink stick in a set but in different positions on the ink sticks from set to set. The adjustable key shape may be provided by a movable key element alone or a movable key element in conjunction with a fixed element.

In the embodiment of FIG. 8, the series keying function of the insertion opening of FIG. 8 is provided by movable key assembly 104. The movable key assembly 104 includes a key element 108 and support 110. The support 110 of the key assembly 104 is configured to be movably mounted or supported adjacent an insertion opening 24 such that at least a portion of the key element 108 of the key assembly protrudes into the insertion opening 24 to define a portion of the perimeter shape of the insertion opening 24. The key element may be an inset or protrusion in the movable key which, by definition of influencing the insertion opening shape, protrudes at least partially into the insertion opening in order to establish the full periphery and keying shape. The insertion opening in this context encompasses the area being influenced by the movable key whether by incorporating an exclusionary feature (protruding) or accommodating feature (inset). The key element 108 of the movable key assembly that protrudes into the insertion opening may have a shape that is complementary to a shape of a series key contour 84A, 84F incorporated into at least a first ink stick 30E and a second ink stick 30F. The key element 108 may have a shape that is complementary to substantially any form of key contour that may be incorporated into ink sticks. In the embodiment of FIG. 8, the key element 108 of the adjustable insertion opening system has a rounded shape corresponding to the rounded shape of the series key contour 84E, 84F incorporated into the first and second ink sticks depicted in FIG. 8.

The key element support 110 may have any suitable configuration that enables the insertion key element 108 to be supported adjacent an insertion opening 24 of an ink delivery system and to be moved between at least two predetermined positions E, F at which the insertion key element 108 is adjacent and protruding into the insertion opening 24. In the embodiment of FIG. 8, the key element support 110 comprises a support arm. Guide and alignment members (not shown) such as brackets or similar devices may be utilized in the imaging device to facilitate and guide the movement of the key element support 110. As shown in FIG. 8, the support may extend under the key plate 26 so that the support 110 is inside the printer and not externally accessible. The key element 108 that extends into insertion opening may be configured to extend upwardly so that the top of the key element is substantially flush with the top surface or plane of the key plate 26 surrounding the insertion opening 24.

In one embodiment, the key element 108 and support 110 of the key assembly may be formed integrally of any suitable material such as plastic or metal. The key element, however, may be formed separately and fixedly or removably attached to the support of the key assembly in any suitable manner. Similarly, the support may be may be configured for removable attachment to the ink delivery system so that the movable key assembly may be easily replaced in the field if damaged or in order to reconfigure the insertion openings.

The movable key assembly 104 is operably coupled to a positioner 114 that is configured to move the key element 108 between two or more pre-selected positions, E, F in relation to the insertion opening 24. For example, the key element positioner 114 of FIG. 8 is configured to move the key element 108 to at least a first position E adjacent a perimeter of the insertion opening 24 and a second position F adjacent the perimeter of the insertion opening 24. In this embodiment, the first position E corresponds to a position of the series key contour 84E on the first ink stick 30E and the second position F corresponds to a position of the series key contour 84F on the second ink stick 30F.

The positioner 114 may comprise any suitable device that is capable of imparting the necessary motion to the insertion key element to move the key element between at least two predetermined positions in relation to an insertion opening. For example, the positioner may be configured to impart the necessary motion pneumatically, electrically, mechanically or any combination thereof and may comprise a motor, solenoid or any similar device. In one embodiment, the positioner comprises a motor with a leadscrew coupling that is capable of providing the necessary movement and may then be held securely in place so as to withstand attempts to alter its position by manual manipulation once the position of the insertion element has been set. In another embodiment, the positioner comprises a solenoid driven element that may be capable of being locked in place when driven to one of the solenoid travel limits.

As mentioned, the insertion key element 108 of the adjustable insertion opening system is configured to be moved between at least two predetermined positions, or configuration settings, in relation to the insertion opening in order to reconfigure the insertion opening shape to accept a first ink stick shape and to exclude a second ink stick shape or to accept the second ink stick shape and to exclude the first ink stick shape. One way exclusion may intentionally be implemented. As example, a second shape may be admitted in an opening configured for the first or the second shape but the first shape would not be admitted through an opening configured for the second shape. The system, however, may be configured to move the insertion key element to any suitable number of positions that correspond to key contour positions in a plurality of different ink stick configurations. One of the multiple configuration settings may be used as a default and the default may be a setting that allows one ink set to be inserted. In another embodiment, the adjustable insertion opening system may be configured to include a preliminary configuration setting, or factory position, at which the insertion key element may be positioned in relation to an insertion opening that is intended to prevent or block the insertion of any, none or all ink sticks until the adjustable insertion opening system has been "set" to utilize a particular ink stick configuration.

The system includes a controller 118 that is operably coupled to the positioner 114 to actuate the positioner to move the insertion key element 108 to the first position E or the second position F, or to any other desired position with respect to the insertion opening. In one embodiment, the controller 118 is configured to actuate the positioner 114 to move the insertion key element to one of a plurality of preselected positions along the perimeter of the insertion opening based on input to the imaging device that identifies the ink stick or ink stick set that is to be used with the product at its end user site. Accordingly, the controller is configured to receive as an input an ink stick identifier that indicates an ink stick type or configuration that is intended to be used with the imaging device. In response to receiving a particular ink stick identifier, the controller is configured to actuate the positioner to move the insertion key element of the adjustable insertion opening system to a predetermined position in relation to an insertion opening that corresponds to the ink stick identifier received by the controller. Any suitable device or method may be utilized to provide the controller with an appropriate ink stick identifier. For example, ink stick identifiers may be input via the control panel of the imaging device or a computer operably coupled to the imaging device via a communications network. In other embodiments, ink stick identifiers that enable a controller to set the adjustable insertion opening system to one of the predetermined positions may be provided by an identifier (ID) chip, configuration card, sensed features of the ink stick, or memory device that may be inserted into the imaging device. Ink stick identifiers may have any suitable form capable of conveying meaning to the controller such as a string of alphanumeric characters. The point in time relative to product set up at the end user site where the ink delivery system is configured for use with appropriate ink sticks may occur at the factory, a distribution site, a point of sale location, the end user site or any other appropriate location.

Figure 9:
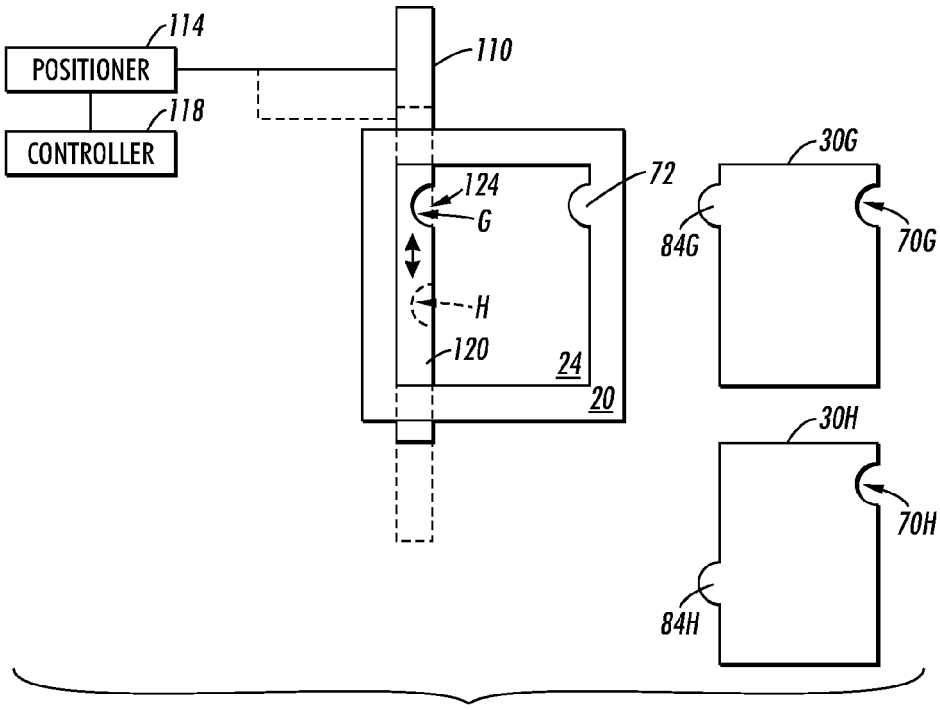
FIG. 9 shows an alternative embodiment of an adjustable insertion opening system for use with a single insertion opening.

Mechanized or movable elements that alter ink stick insertion opening configurations may be configured to alter a portion or all of a perimeter segment of an insertion opening. For example, key elements of movable key assemblies may correspond to movable surround elements that define one or more entire perimeter segment shapes of an insertion opening and may include one or more contour shapes that correspond to key contours incorporated into ink sticks. The contour shapes incorporated into movable surround elements may be complementary to recessed or protruding key contour shapes. For example, FIG. 9 shows an embodiment of a movable key assembly 110 that includes a movable surround element 120 having a key shaped contour 124 that is complementary to a protruding key contour 84G, 84H that may be incorporated into an ink stick. The movable surround element 124 is movable with respect to the insertion opening 24 so as to alter the position of the key shaped contour 124 of the movable surround element along the perimeter of the insertion opening 24 to correspond to the position of the key contour 84G, 84H of the ink sticks 30G, 30H. Surround elements need not completely encircle the opening perimeter.

A separate movable key assembly may be separately provided for one or more insertion openings of an ink delivery system. In such an embodiment, each movable key assembly may be separately controlled by controller to adjust each insertion opening individually. The movable key assemblies may be utilized to provide series and/or color keying functions to the insertion openings of the ink delivery system. More than one movable key may be provided for a single insertion opening that may be movable as a unit or separately adjustable. In addition, movable key elements may be provided along substantially any of the perimeter segments of an insertion opening.

Figure 10:
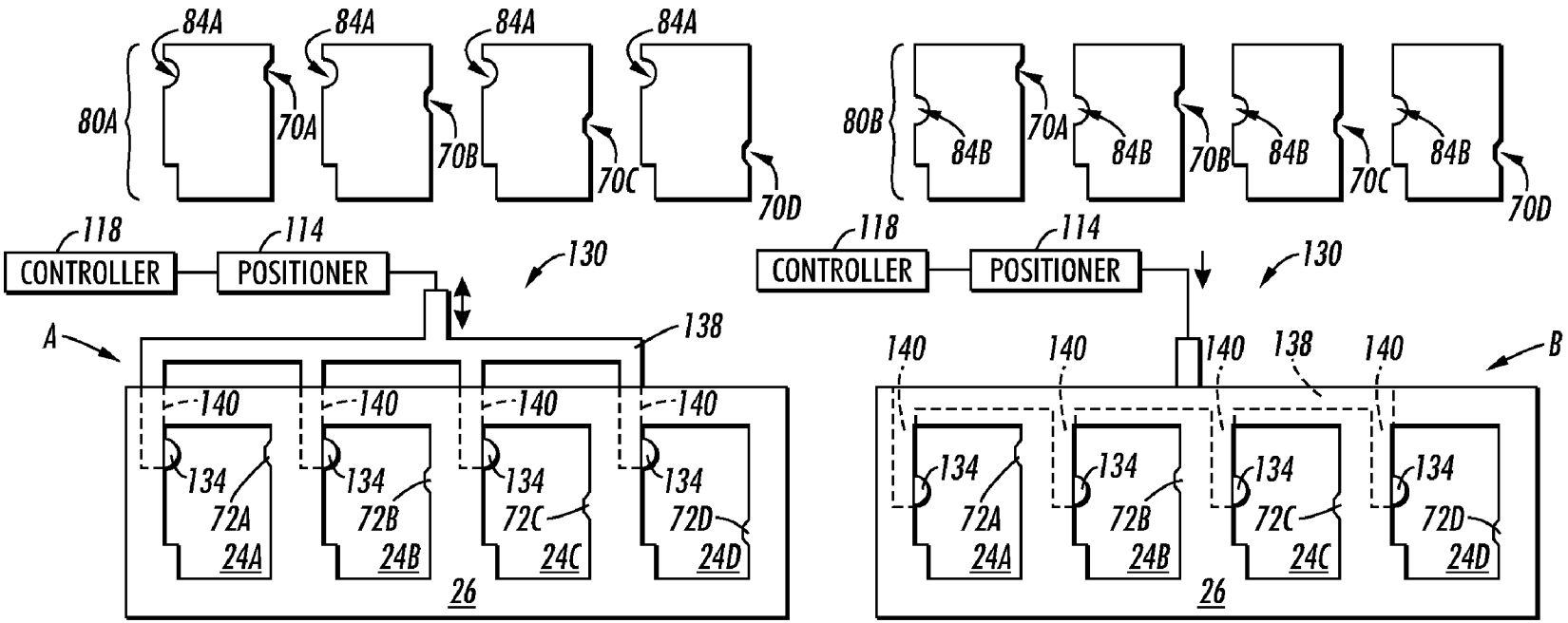
FIG. 10 shows an embodiment of an adjustable insertion opening system for use with multiple insertion openings.

As an alternative to providing individually controlled movable key assemblies for each insertion opening, the movable key assemblies for each insertion opening of an ink delivery system may be coupled so that all of the insertion openings of an ink delivery system may be adjusted simultaneously. For example, FIG. 10 shows an embodiment of an adjustable insertion opening system 130 that is configured to adjust all of the insertion openings 24 of an ink delivery system to enable the insertion of a first set of ink sticks 80A into the insertion openings 24 and to exclude or block from insertion a second set of ink sticks 80B or to enable the insertion of the second set of ink sticks 80B into the insertion openings 24 and to exclude or block from insertion the first set of ink sticks 80A. As can be seen, the first set of ink sticks 80A and the second set of ink sticks 80B each includes a series key contour 84A, 84B that is in the same position on each ink stick in the respective sets but in a different position from set to set. In this embodiment, adjustable insertion opening system includes a movable key element 134 for each insertion opening of the ink delivery system.

In the embodiment of FIG. 10, the series keying function of the ink delivery system is provided by movable key assembly 130. In this embodiment, the movable key assembly 130 includes a key element 134 for each insertion opening 24 of the ink delivery system and a support 138. The support 138 of the key assembly 130 is configured to be movably mounted or supported adjacent the insertion openings 24 such that each key element 134 protrudes into the insertion opening 24 to define a portion of the perimeter shape of the respective insertion openings 24. Each key element 134 has a shape that is complementary to a shape of a series key contour 84A, 84B incorporated into the first 80A and second set 80B of ink sticks.

The key element support 138 may have any suitable configuration that enables each insertion key element 134 to be supported adjacent the appropriate insertion opening of the ink delivery system such that movement of the support 138 causes a corresponding movement of the key elements 134 in relation to the respective insertion openings. In the embodiment of FIG. 10, the support includes a support arm 140 for each key element 134. Each support arm 140 is configured to extend along a perimeter segment of one of the insertion openings 24 so that the respective key elements 134 extend or protrude into the insertion openings. The support 130 is configured to be moved between at least two predetermined positions A, B that correspond to the two positions of the series key contours 84A, 84B of the first and second sets of ink sticks, respectively. Guide and alignment members (not shown) such as brackets or similar devices may be utilized in the imaging device to facilitate and guide the movement of the key element support. In the embodiment of FIG. 10, the support 138 is operably coupled to a positioner 114 that is configured to move the support 138 such that the key elements 134 of the movable key assembly are moved between the at least two positions A, B corresponding to the series key contour positions of the first and second set of ink sticks. Key elements have been generally described as being inset or protruding into an insertion opening, however, the key feature of the ink stick may be protruding the ink stick may have a combination of inset and protruding key features. Movable key elements or assemblies may be likewise configured.

Figure 11A:
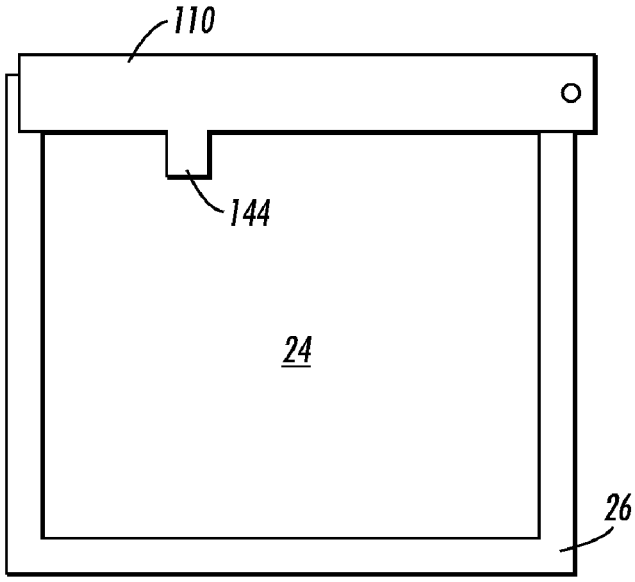
FIG. 11 shows an embodiment of an adjustable insertion opening that utilizes pivotal movement.
Figure 11B:
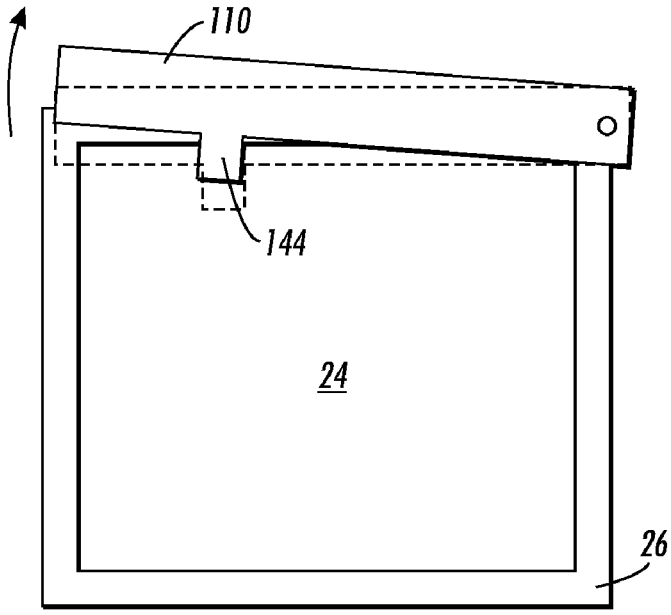
Figure 12A:
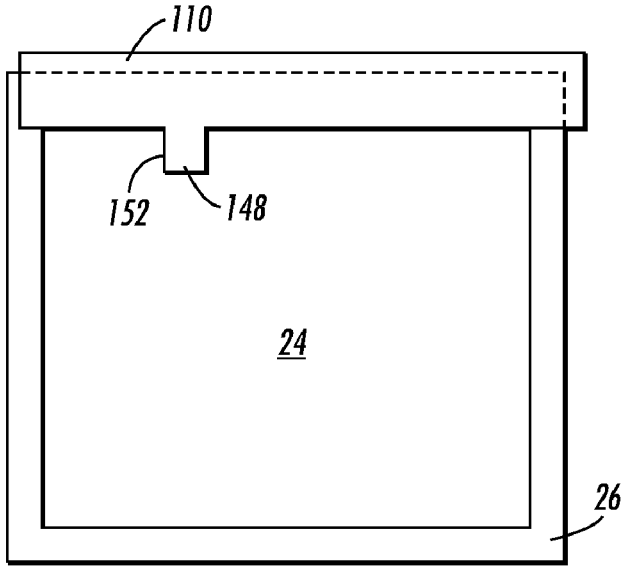
FIG. 12 shows an embodiment of an adjustable insertion opening that utilizes translational movement.
Figure 12B:
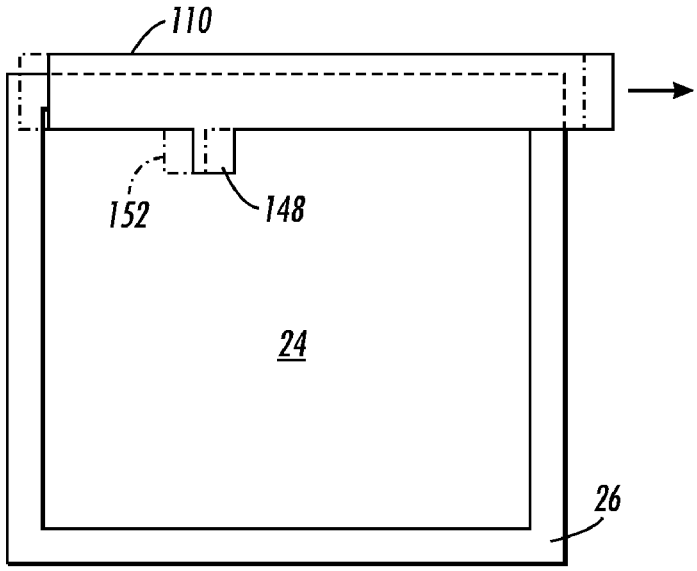

FIGS. 11-12 show alternative embodiments of adjustable insertion openings. In particular, FIGS. 11*a* and 11*b* show an embodiment of a movable key element and key element support that is configured to adjust the distance that the movable key element extends into the insertion opening. FIG. 11, for example, shows an insertion opening 24 that includes a movable key element 144 and key element support 110. In this embodiment, the key element support is configured for pivotal movement relative to the insertion opening thereby adjusting or altering the depth or distance that the movable key element protrudes into the insertion opening. FIG. 11*a* shows the insertion opening with the movable key element 144 positioned to extend into the insertion opening 24 at a maximum distance. Pivotal movement of the key element support 110 enables the distance that the movable key element extends into the opening 24 to be varied to accommodate multiple key contours of different depths. Pivotal movement of the movable key element may be accomplished in any suitable manner.

As mentioned above, the adjustable key shape may be provided by a movable key element in conjunction with a fixed element. FIG. 12 shows an embodiment of such a system that is configured to adjust the width of a key element. For example, FIG. 12 depicts an insertion opening, a movable key element 148, a key element support 110, and a fixed key element 152. As shown in FIG. 12*a*, the movable key element 148 may be positioned to completely overlap the fixed key element to enable the insertion of ink sticks through the opening that have a key contour with a width that is at least as wide as the movable key element 152. The key element support may be translated in any suitable manner so that the movable key element partially overlaps or does not overlap the fixed key element 152 in order to widen the key element structure in the insertion opening 24. In this way, the movable key element may be used to widen or expand the length of the key so that a longer complementary feature in an ink stick would pass either the short or long adjustable key position but a shorter complementary feature in an ink stick would only pass if the adjustable position was in the short configuration. Positioning in this way may also include three or more lengths or widths or inset or protruding depths.

Those skilled in the art will recognize that numerous modifications can be made to the specific implementations of the adjustable insertion opening key elements described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A system for use with a solid ink delivery system of a phase change ink imaging device, the system comprising:

an insertion opening configured to enable insertion of ink sticks therethrough and into an ink delivery system of a phase change ink imaging device;

an insertion key movably supported adjacent the insertion opening, at least a portion of the insertion key influencing the insertion opening shape; and a key positioner operably coupled to the insertion key that is configured to move the insertion key between at least two different predetermined positions on a perimeter of the insertion opening.

2. The system of claim 1, the portion of the insertion key influencing the insertion opening shape being complementarily shaped to a key contour in a first and a second ink stick.

3. The system of claim 2, the at least two predetermined positions including a first position that is complementary to a position of the key contour of the first ink stick and a second position that is complementary to a position of the key contour of the second ink stick.

4. The system of claim 1, the positioner comprising a motor including a leadscrew connecting the motor to the insertion key.

5. The system of claim 1, the positioner being configured to move the portion of the insertion key influencing the insertion opening shape between the first, the second, and a third position on the perimeter of the insertion opening, the third position corresponding to a key contour formed on a third ink stick.

6. The system of claim 1, further comprising:

a controller operably coupled to the positioner, the controller being configured to receive an ink stick identifier as an input and configured to actuate the positioner to move the insertion key to one of the predetermined positions based on the ink stick identifier received as an input.

7. The system of claim 6, the controller being configured to receive the ink stick identifier via a control panel of an imaging device.

8. The system of claim 1, the insertion opening including at least one fixed key element having a shape complementary to a color key contour formed on the first and the second ink sticks.

9. The system of claim 1, further comprising:

a plurality of insertion openings, each insertion opening being configured to provide access to a different feed channel of an ink delivery system; and a separate insertion key movably supported adjacent each insertion opening in the plurality of insertion openings;

the positioner being operably coupled to each insertion key and configured to move each of the insertion keys between at least two different predetermined positions on the perimeter of each of the insertion openings.

10. A system for use with a phase change ink imaging device, the system comprising:

an ink delivery system for a phase change ink imaging device;

a plurality of adjustable insertion openings configured to enable insertion of ink sticks therethrough and into the ink delivery system, each opening in the plurality of insertion openings being configured to receive a different color of ink stick, each of the adjustable insertion openings in the plurality including:

an insertion key movably supported adjacent the respective insertion opening such that a portion of the insertion key influences the insertion opening shape, the portion of the insertion key having a shape that is complementary to a key contour that is incorporated into a first and a second set of multi-color ink sticks;

a key positioner operably coupled to each of the insertion keys in the plurality that is configured to move the insertion keys such that the portion of the insertion key that protrudes into the respective insertion openings is moved between at least two different predetermined positions on the perimeter of the insertion opening, the at least two predetermined positions including a first position that is complementary to a position of the series key contour on the first set of ink sticks and a second position that is complementary to a position of the series key contour on the second set of ink sticks.

11. The system of claim 10, further comprising:

a support operably coupled to each of the insertion keys, the support including a plurality of support arms, each support arm being configured to support at least one insertion key adjacent at least one insertion opening;

the key positioner being operably coupled to the support to move the support between at least two positions, the support arms of the support being arranged such that movement of the support between the at least two positions causes a corresponding movement of the each of the support arms to move the portion of the insertion keys that protrudes into the insertion openings between the at least two predetermined positions.

12. The system of claim 11, further comprising:

a controller operably coupled to the positioner, the controller being configured to receive an ink stick identifier as an input and configured to actuate the positioner to move the insertion keys to one of the predetermined positions based on the ink stick identifier received as an input.

13. The system of claim 12, the controller being configured to receive the ink stick identifier via a control panel of an imaging device.

14. The system of claim 10, the positioner comprising a motor.

15. The system of claim 14, the motor including a lead-screw coupling for connecting the motor to the support.

16. The system of claim 10, the positioner being configured to move the support such that the portion of the insertion keys influencing the insertion opening shapes is moved between the first, the second, and a third position on the perimeter of the insertion openings, the third position corresponding to a series key contour formed on a third set of ink sticks.

17. A phase change ink imaging device comprising:

a phase change ink printhead configured to eject melted phase change ink onto an ink receiver;

an ink delivery system configured to receive solid ink sticks and to transport the solid ink sticks to an ink melter for melting and delivery to the phase change ink printhead;

a plurality of adjustable insertion openings configured to enable insertion of ink sticks therethrough and into the ink delivery system, each opening in the plurality of insertion openings being configured to receive a different color of ink stick, each of the adjustable insertion openings in the plurality including:

an insertion key movably supported adjacent the respective insertion opening such that a portion of the insertion key influences the insertion opening shape, the portion of the insertion key having a shape that is complementary to a key contour that is incorporated into a first and a second set of multi-color ink sticks;

a key positioner operably coupled to each of the insertion keys in the plurality that is configured to move the insertion keys such that the portion of the insertion key that influences the respective insertion opening shapes is moved between at least two different predetermined positions on the perimeter of the insertion opening, the at least two predetermined positions including a first position that is complementary to a position of a key contour on the first set of ink sticks and a second position that is complementary to a position of a key contour on the second set of ink sticks.

18. The imaging device of claim 17, further comprising:

a controller operably coupled to the positioner, the controller being configured to receive an ink stick identifier as an input and configured to actuate the positioner to move the insertion keys to one of the predetermined positions based on the ink stick identifier received as an input.

19. The imaging device of claim 18, the controller being configured to receive the ink stick identifier via a control panel of the imaging device.

20. The imaging device of claim 17, the plurality of adjustable insertion openings each including at least one fixed insertion key, the fixed insertion key being complementary positioned along the perimeter of the insertion opening to a position of a color key contour on an ink stick.

* * * * *